US009312049B2

(12) United States Patent
Schmidt et al.

(10) Patent No.: US 9,312,049 B2
(45) Date of Patent: Apr. 12, 2016

(54) ELECTRICAL CONTACT ELEMENT WITH A COVER LAYER HAVING A CHEMICAL REDUCING AGENT, ELECTRICAL CONTACT ARRANGEMENT AND METHODS FOR MANUFACTURING AN ELECTRICAL CONTACT ELEMENT AND FOR REDUCING OXIDIZATION OF A CONTACT SECTION OF AN ELECTRICAL CONTACT ELEMENT

(75) Inventors: Helge Schmidt, Speyer (DE); Josh Golden, Aptos, CA (US)

(73) Assignees: TE Connectivity Germany GmbH, Bensheim (DE); Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 14/119,672

(22) PCT Filed: May 14, 2012

(86) PCT No.: PCT/EP2012/058912

§ 371 (c)(1),
(2), (4) Date: Nov. 22, 2013

(87) PCT Pub. No.: WO2012/159917

PCT Pub. Date: Nov. 29, 2012

(65) Prior Publication Data

US 2014/0102759 A1 Apr. 17, 2014

(30) Foreign Application Priority Data

May 25, 2011 (EP) ..... 11167524

(51) Int. Cl.
*H01B 5/00* (2006.01)
*H01H 1/02* (2006.01)
(Continued)

(52) U.S. Cl.
CPC ..... *H01B 5/002* (2013.01); *H01H 1/02* (2013.01); *H01R 13/03* (2013.01); *H01R 13/035* (2013.01); *H01R 43/00* (2013.01); *H01R 43/16* (2013.01); *Y10T 29/49204* (2015.01)

(58) Field of Classification Search
CPC ..... H01B 5/00; H01R 13/02; H01H 1/02
USPC ..... 439/886; 427/58
See application file for complete search history.

(56) References Cited

U.S. PATENT DOCUMENTS

| | | | | |
|---|---|---|---|---|
| 5,021,300 | A * | 6/1991 | Stacey | 428/620 |
| 8,110,285 | B2 * | 2/2012 | Garandet et al. | 428/323 |
| 2006/0105641 | A1 * | 5/2006 | Rehbein et al. | 439/886 |

FOREIGN PATENT DOCUMENTS

| | | |
|---|---|---|
| EP | 2148393 A1 | 1/2010 |
| WO | WO 03/050920 | 6/2003 |

(Continued)

OTHER PUBLICATIONS

International Search Report and Written Opinion issued by the European Patent Office, dated Jul. 16, 2012, for related International Application No. PCT/EP2012/058912; 11 pages.

(Continued)

*Primary Examiner* — Amy Cohen Johnson
*Assistant Examiner* — Oscar C Jimenez
(74) *Attorney, Agent, or Firm* — Faegre Baker Daniels LLP

(57) ABSTRACT

The invention relates to an electrical contact element, an electrical contact arrangement and methods for manufacturing an electrical contact element and for reducing oxidization of a contact section of an electrical contact element. In order to avoid that the durability of the contact element and therefore of the contact arrangement is negatively influenced by growing oxide layers on contact surfaces, the contact element is provided with a cover layer with a chemical reducing agent that can be activated by frictional forces.

18 Claims, 2 Drawing Sheets

(51) Int. Cl.

| | |
|---|---|
| ***H01R 13/03*** | (2006.01) |
| ***H01R 43/16*** | (2006.01) |
| ***H01R 43/00*** | (2006.01) |

(56) References Cited

FOREIGN PATENT DOCUMENTS

WO WO 2004/032166 A1 4/2004

WO WO 2005/057732 A1 6/2005

OTHER PUBLICATIONS

International Preliminary Report on Patentability issued by the International Bureau of WIPO, Geneva, Switzerland, dated Nov. 26, 2013, for International Application No. PCT/EP2012/058912; 6 pages.

* cited by examiner

ELECTRICAL CONTACT ELEMENT WITH A COVER LAYER HAVING A CHEMICAL REDUCING AGENT, ELECTRICAL CONTACT ARRANGEMENT AND METHODS FOR MANUFACTURING AN ELECTRICAL CONTACT ELEMENT AND FOR REDUCING OXIDIZATION OF A CONTACT SECTION OF AN ELECTRICAL CONTACT ELEMENT

BACKGROUND OF THE DISCLOSURE

The present invention relates to an electrical contact element with a cover layer arranged at least on a contact section of the contact element, the cover layer being electrically conductive. Furthermore, the invention relates to an electrical contact arrangement with at least one electrical contact element and at least one counter-contact element for the electrical contact element, the counter-contact element being adapted to mechanically contact a contact section of the electrical contact element. Moreover, the invention relates to a method for manufacturing an electrical contact element by adding a cover layer, and to a method for reducing oxidization of a contact section of an electrical contact element.

Electrical contact elements are widely used to provide electrical connections with counter-contact elements. The contact elements may be plug or switch contact elements. Movements of the contact elements and/or the counter-contact elements relative to each other may cause mechanical abrasion of at least one of the contact elements and in particular, of a contact surface of the contact section of the respective contact element. Damage to the contact surface may lead to exposure of the previously unexposed electrically conductive material of the cover layer. The conductive material may be metal which oxidizes when in contact with oxygen, e.g. contained in air. The oxidized material may form a layer on the contact element especially in the area of the contact section. If the contact surface is repeatedly damaged, the oxidized layer may grow in thickness and impair the electrical conductivity, in particular, of the contact surface. This may lead to a malfunction of the electrical connection between the contact element and the counter-contact element.

Even if the contacts are not moved in the way described above, the contact section may be damaged. In particular, vibrations or movements caused by thermal elongation may cause damage in the contact surface.

Hence, the durability of the contact elements and of the electrical contact arrangement may be limited due to the decreasing electrical conductivity caused by the growing oxide layer thickness.

In view of these disadvantages of the known electrical contact elements, an object underlying the invention is to provide electrical contact elements with an improved durability.

The object is achieved according to the invention for the electrical contact element mentioned in the beginning in that the cover layer comprises a chemical reducing agent that is adapted to reduce metal oxides of the cover layer. For the electrical contact arrangement mentioned above, the object is achieved according to the present invention in that the contact element is formed according to the invention. For the manufacturing method mentioned above, the object is achieved according to the present invention in that the method comprises the step of embedding a chemical reducing agent in the cover layer. For the method for reducing oxidation, the object is achieved in that the method comprises the step of applying frictional forces to a cover layer arranged on the contact section and thereby releasing a chemical reducing agent.

These simple solutions provide that oxidization of damaged contact surfaces is during the operation of the contact element decelerated or even prevented and may even, at least partially, be reversed.

The solutions according to the invention can be combined as desired and further improved by the following embodiments that are in each case advantageous on their own.

SUMMARY OF THE DISCLOSURE

According to a first possible embodiment, the cover layer may be adapted to release at least a part of the reducing agent at least when the contact surface of the cover layer is damaged. As the cover layer contains the chemical reducing agent, the chemical reducing agent is automatically released when the contact section is at least superficially damaged. Hence, a malfunction of the contact element due to too high electrical resistance caused by a too thick oxide layer is avoided, as the reducing agent at least reduces the growth of the oxide layer. Releasing only a part of the reducing agent provides that current, and future possible damages of the contact surface, does not lead to unacceptable growth of an oxide layer.

As the cover layer is to be electrically conductive, the cover layer may, at least partially, be made of a conductive metal, e.g. nickel, tin or an alloy. However, it may not be possible to dissolve the reducing agent in the chosen material of the cover layer. In order to be able to store the reducing agent in the cover layer, the reducing agent may be embedded in the cover layer, e.g. in local concentrations or droplets. Each of the local concentrations may be provided in cavities inside the material of the cover layer. The cover layer may be provided with a plurality of local concentrations, i.e. a plurality of cavities, of which at least some may be arranged close to the contact surface in the area of the contact section.

In order to be able to easily embed the reducing agent in the cover layer, the reducing agent can be provided or received in particles, which can be embedded in the cover layer. The reducing agent may be a solid or liquid chemical compound at least sectionwise arranged in or forming the particle.

Particles can more easily be handled compared to gases or liquids. For embedding the particles in the cover layer, the particles can have a smaller maximum dimension than the cover layer and in a direction parallel to the thickness of the cover layer.

The particles may comprise a receiving body for the reducing agent. The receiving body may be a sponge-like body, which can absorb a gaseous or liquid reducing agent, e.g. by the capillary effect. Particles with sponge-like structure can easily be filled with the chemical reducing agent, as in particular, such a particle may absorb liquid reducing agents independently.

Sponge-like particles, however, may not be able to contain the reducing agent and to separate it from the material of the cover layer, the properties of the material being potentially affected by the reducing agent in an undesired way. Hence, in order to separate the reducing agent from the material of the cover layer, the receiving body may be formed as an outer shell which encases the reducing agent. Alternatively, the particles may be solid and/or comprise or even consist of at least one solid chemical compound or a homogenous or heterogeneous mixture of solid and/or non-solid chemical compounds, at least one chemical compound comprising the reducing agent and possibly at least one, two, three or more additives.

The particles may provide chemical reducing action when frictional forces between the cover layer and the counter-contact element occur. The frictional forces may occur during normal operation of the contact element, e.g. during plug or switch actions or when small movements of the contact element relative to the counter-contact element, against which the contact element at least sectionwise lies, occur.

In order to be able to arrange the particles in cover layers with a thickness of e.g. about or less than 1 mm, the particles may be formed as microcapsules. In particular, the cover layer thickness may be less than 50 μm.

A microcapsule may be defined as a body with a shell surrounding a core, the core comprising the reducing agent in a small quantity. For instance, a microcapsule may have a maximum dimension or diameter between 1 and 100 μm and maybe even up to 500 μm. In order to be able to embed the microcapsules even in thin cover layers, their maximum dimension or diameter may be between 0.1 and 2 μm. Such a small microcapsule may also be designated as nanocapsule. The microcapsule may be spherical or may have an asymmetric or variable shape.

The particles may also be designated as a colloid, the receiving body forming the dispersing agent and the reducing agent being a droplet absorbed or arranged in the receiving body.

In order to ensure that the particles are activated and the reducing agent is released at least when frictional forces occur that e.g. damage the cover layer at least superficially, the particles may be adapted to have a mechanical resilience that is below the mechanical resilience of the cover layer. For instance, the mechanical properties of the receiving body and in particular its material properties or its outer shell thickness may be selected to fulfil the above mechanical resilience requirement. Hence, by such a design of the particles, it is ensured that the particles are destroyed and the reducing agent is released at least when the cover layer is damaged.

Alternatively or additionally, the particles may be activated by melting or abrading at least parts of the particles. In particular the outer shell or the solid particle may be molten or dispersed by heat energy generated by the frictional forces between the cover layer and the counter-contact element.

Furthermore, the frictional forces may be sufficient to cause local mixing of compounds of the heterogeneous mixture of chemical compounds of the particle. Due to this mixture, the particle may at least sectionwise liquefy sufficiently or have enough chemical activity to provide the reducing action.

Furthermore, in order to avoid an undesired degradation of the particles, the receiving body may be substantially chemically resistant such that the structural integrity of the receiving body is maintained and in particular not affected by the reducing agent. Materials with a sufficient chemical resistance may be synthetic or natural polymers.

The receiving body may comprise a polymer, e.g. a polyester or a polyamide. The polymer can be selected from known polymers, such that it effectively isolates the reducing agent from the cover layer material over a desired time and breaks when the cover layer is damaged. The polymer can also be chosen such that it does not influence the electrical conductivity of the contact element in a noteworthy way. It may be sufficient that the amount of polymer material in the cover layer is low and that broken particles do not cover and thus insulate large areas of the contact section. In order to improve the electrical conductivity of the contact element and, in particular, of the cover layer, a polymer that is electrically conductive can be selected.

The reducing agent may comprise at least one flux material, e.g. an organic or inorganic acid, and of a list comprising multi-protic fluxing acid, linear fluxing acid, dendritic fluxing acid, branched fluxing acid, abietic acid, stearic acid and adipic acid. The flux material can be selected in order to provide optimal performance in reducing metal oxides without negatively influencing the structure of the cover layer due to unintentional chemical reactions with the cover layer material or the receiving body.

The average density of the particles in the cover layer may be sufficiently high to provide an appropriate fluxing action and a sufficient reduction of the oxidized material of the cover layer.

Further examples of fluxes that may be used are borax, borates, fluoroborates, fluorides, chlorides, halogenides, metal or organohalides, hydrochloric acid, phosphoric acid, hydrobromic acid, salt of mineral acids, carboxylic acids, dicarboxylic acids or any other suitable materials or material mixes.

The electrical contact element with the chemical reducing agent in the cover layer effectively reduces the negative effects of oxide layers in such a way, that the contact element heals itself by removing or reducing the growth of oxide layers, at least partially. The reducing agent degrades the oxide layer chemically and may furthermore be adapted to form a separation or protection film on the contact surface, the separation or protection film forming a barrier that may separate the contact surface from oxygen, i.e. from air. Furthermore, the reducing agent may bind oxygen before it reaches the contact surface covered by the film. Hence, the damaged contact surface may be protected by the separation or protection film from oxidation.

In order to avoid a fast growth of oxide layers, it may also be advantageous to avoid damage of the contact surface. To solve the above-mentioned problem, the contact element may be provided with a cover layer having a contact surface, the frictional coefficient of which is decreased at least when the contact surface is breached and compared to the frictional coefficient of a cover layer with an intact contact surface. In order to provide the improved frictional coefficient, the cover layer may comprise a surface lubricant.

A contact element with a cover layer comprising a surface lubricant may be used without the chemical reducing agent, as further damages and growing oxide layer thicknesses resulting from the damage are also effectively reduced by the surface lubricant on its own. Hence, a contact element with a cover layer comprising a surface lubricant on its own is an advantageous embodiment of the invention which itself solves the problem underlying the invention. The lubricant may not only reduce the frictional coefficient but could also form the separation or protection film covering the contact surface, at least partially, and separating gaseous oxygen surrounding the contact element from the contact surface. Hence, the damaged contact surface may be protected by the separation or protection film from oxidation.

The lubricant may replace the reducing agent and the remaining features of the contact element according to the invention may remain the same. However, a contact element with a cover layer comprising the surface lubricant and the chemical reducing agent may increase the durability of the electrical contact element even further than a contact element with the cover layer comprising the reducing agent or the surface lubricant. Thus, the cover layer may comprise both the reducing agent and the lubricant.

At least some of the particles may comprise the lubricant or the flux material only. By separating the lubricant and the flux material in different particles, the flux material does not come into contact with the lubricant before the particles are broken. Consequently, the lubricant may not be affected by the reducing agent or vice versa, before the contact surface is damaged.

Furthermore, the ratio between lubricant and reducing agent can easily be adjusted during the production of the contact element by mixing the desired amounts of particles with lubricant and with reducing agent.

If, however, the lubricant is not undesirably affected by the reducing agent and if adjusting the ratio of the lubricant and the reducing agent does not need to be done by changing the amount of the different particles, the particles may comprise the surface lubricant and the chemical reducing agent. The reducing agent may even comprise the lubricant or may be a lubricant. For instance, lubricating oils or fatty acids are both lubricants and fluxes. Alternatively or additionally, the receiving body itself may have lubricating properties, or may contain the lubricant. The lubricant may comprise graphitic particles or other materials that enhance contact lubrication. Again, the lubricant shall not increase contact resistance improperly. Furthermore, the receiving body may comprise lubricant polymer compositions.

In particular, the lubricant may be a material selected from a list comprising lubricating polymers, lubricating fluxes, lubricating acids and graphite particles. The selection may be based on chemical stability with respect to the reducing agent, lubricating properties and electrical conductivity of the lubricant.

In order to enhance the mechanical stability of the contact element and in particular of the contact surface, a metallic protection layer may be arranged between the cover layer and a core body of the contact. The metallic protection layer may comprise nickel or a nickel alloy. The core body of the contact may be the carrier for the cover layer and/or the metallic protection layer and could, for instance, comprise copper or copper alloy.

If the contact element is used in an electrical contact arrangement, the counter-contact element may also be formed according to the invention and may at least comprise the cover layer with the reducing agent and/or with the lubricant. Furthermore, the counter-contact element may also comprise the metallic protection layer arranged between the cover layer and the core body.

Electrical contact elements or counter-contact elements according to the invention may be manufactured by the method mentioned above. The cover layer may be added by coating or plating, in particular by electroplating. The chemical reducing agent and/or the lubricant may be suspended in a plating bath and co-deposited with an electrically conductive material. The electrically conductive material may together with the reducing agent and/or the lubricant and possibly with the receiving bodies, form the cover layer.

When building up the cover layer, and thereby embedding the particles, the ambient conditions, in particular in an electroplating bath, may influence the structural integrity of the particle. For instance, the pH-value of the electroplating bath may be low and e.g. between 0.1 and 2. In an electroless plating bath, on the other hand, the pH-value may be very high. In order to maintain the structural integrity of the particles, the receiving body may be sufficiently chemically resistant, such that it is not degraded too much by the conditions of the chosen coating or plating method. In particular, the receiving body material can be selected to survive the building up process of the cover layer and may e.g. be a synthetic or natural polymer.

The invention will be described hereinafter, in more detail and in an exemplary manner using advantageous embodiments and with reference to the drawings. The described embodiments are only possible configurations in which, however, the individual features as described above can be provided independent of one another and can be omitted in the drawings:

DETAILED DESCRIPTION OF THE DRAWINGS

Figure 1:
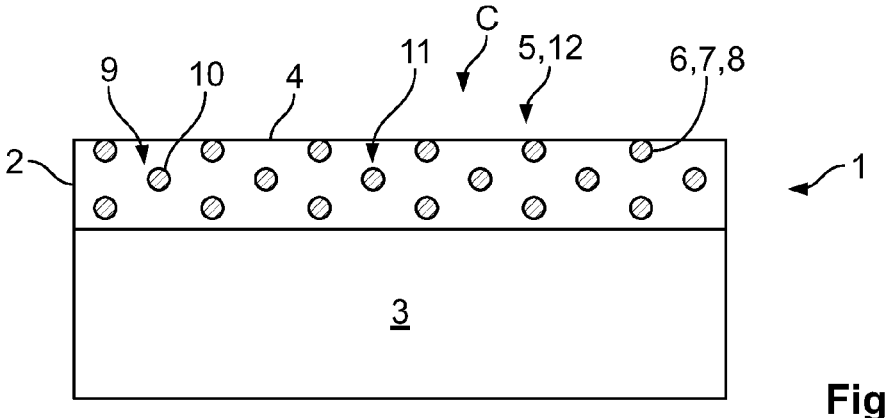
FIG. 1 is a schematic cross-sectional view of an exemplary embodiment of an electrical contact element.

First, an electrical contact element 1 with a cover layer 2 will be described with reference to FIG. 1. The contact element 1 may comprise a core body 3, on which the cover layer 2 may be arranged at least in a contact section C of the contact element 1. The core body 3 may be electrically conductive and may be made of a metal, e.g. copper, silver or an alloy.

The cover layer 2 may also be electrically conductive. A contact surface 4 of the cover layer 2, which may form the contact surface 4 of the contact element 1, may be exposed to air or other gases containing oxygen. Hence, the contact surface 4 may oxidize over time, the oxidized material of contact surface 4 potentially influencing the conductivity of the contact surface 4. The cover layer 2 may comprise a chemical reducing agent 5 that is adapted to reduce metal oxides.

During operation of the contact element 1, the contact surface 4 may be damaged by contact or uncontact procedures with a counter-contact. This damage of the contact surface 4 may result in a broken oxide layer. Due to the broken oxide layer, not yet oxidized parts of the cover layer 2 may be exposed to oxygen and may hence oxidate. This additional oxidation of the cover layer 2 after a broken contact surface 4 may result in a growing oxide layer on the cover layer 2, the growing oxide layer impairing the electrical conductivity of the contact surface 4. In particular, the thickness of the oxide layer may gain, increasing the electrical resistance of the contact element 1 via the contact surface 4.

The cover layer 2 may be adapted to release at least a part of the reducing agent 5 at least when a surface and, in particular, the contact surface 4 of the cover layer 2 is damaged. The released chemical reducing agent 5 may hinder or at least reduce the oxidization of the contact surface 4 and may even reverse the oxidization at least in part.

The reducing agent 5 may be embedded in the cover layer 2. As the cover layer 2 has to be electrically conductive, it may comprise a metal and may e.g. be made of tin, nickel or an alloy. As the reducing agent 5 may not be absorbed by a metal, the reducing agent 5 may be embedded in the cover layer 2 in local concentrations 6 or droplets and may at least predominantly be arranged in closed volumes 7 inside the cover layer 2.

Alternatively or additionally, the reducing agent 5 may be received in particles 8, the particles 8 being embedded in the cover layer 2. Each of the particles 8 may comprise a receiving body 9 for the reducing agent 5. For instance, the receiving body 9 may be formed as a sponge-like absorber for the reducing agent 5. Alternatively, the receiving body 9 may be formed as an outer shell 10 which encloses or encases the reducing agent 5. Each of the particles 8 may comprise the outer shell 10, the outer shell 10 confining each of the closed volumes 7 and separating the chemical reducing agent 5 from the metal material of the cover layer 2.

The particle 8 may be designed as a nano- or micro-capsule 11. Nano- or micro-capsules 11 may be defined as containers with a size in the sub-millimeter range, e.g. below 100 μm, or even below 10 μm and in particular between 0.1 and 2 μm.

In order to release the reducing agent 5, at least when the contact surface 4 of the cover layer 2 is damaged, the particles 8 may be adapted to have a mechanical resilience that is below the mechanical resilience of the cover layer 2. Thus, when the contact surface 4 of the cover layer 2 is broken and if also one of the particles 8 is affected by this damage, this particle 8 will rupture and release the reducing agent 5.

Due to the small size of the particles 8, the ruptured receiving bodies 9 do not affect the electrical conductivity of the contact surface 4 in a noteworthy way. The receiving body 9 may comprise a polymer, which may include polyesters and polyamides or other polymers. If the effect on the electrical conductivity is to be further reduced, electrical conductive receiving bodies 9 may be used.

The reducing agent 5 may comprise at least one flux material of a list comprising multi-protic fluxing acid, linear fluxing acid, dendritic fluxing acid, branched fluxing acid, abietic acid, stearic acid and adipic acid. The fluxing materials may be chosen for best performance with the oxidized material of the cover layer 2 and the material of the receiving bodies 9. Oxide layers of the cover layer 2 shall be effectively reduced and the material of the receiving bodies 9 shall not be affected by the flux material.

In order to avoid or at least reduce the damage of the oxide layer of the contact surface 4, the cover layer 2 may comprise a surface lubricant 12 instead of the reducing agent 5. If at least some particles 8 are broken, the frictional coefficient of the cover layer 2 may be decreased compared to the frictional coefficient of the cover layer 2 with intact particles 8 only. By a low frictional coefficient, damage, e.g. by abrasion, can be reduced effectively. A reduction of damage of the oxide layer leads to a reduced growth rate of the oxide layer. This can already be sufficient for improving the durability of the contact element 1. The lubricant 12 may be embedded in the cover layer 2 and may be received in the particles 8 as described above for the reducing agent 5.

The lubricant 12 may alternatively be provided in addition to the reducing agent 5 in a mixture with the reducing agent 5 or separated from it. The lubricant 12 itself may even be a reducing agent 5, for instance a lubricating flux material. The lubricant 12 may also be a material of a list comprising lubricating acids, lubricating polymers and graphite particles.

The contact element 1 may be a contact element of the plug. The contact surface 4 of such contact element 1 may be damaged by insertion-withdrawal operations of the contact element 1 and a counter-contact element. Additionally, the contact surface 4 may be damaged due to vibrations of interconnected contact elements. Furthermore, the contact surface 4 may be damaged due to thermal elongation of e.g. the electrical contact element 1. Due to the change of dimension, the contact surface 4 may rub against the counter-contact element, which may also cause damage of the contact surface 4.

Figure 2:
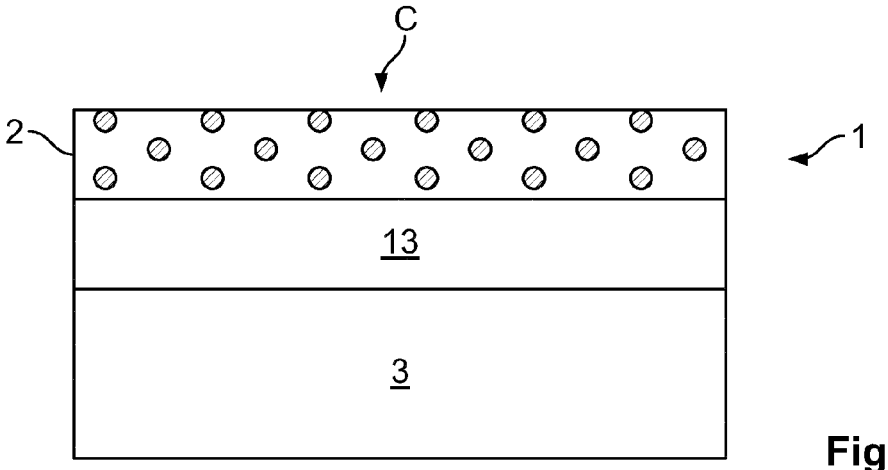
FIG. 2 shows a schematic cross-sectional view of another embodiment of the contact element.

FIG. 2 shows another exemplary embodiment of the contact element 1 in a schematic cross-sectional view. The same reference signs are used for elements which correspond in function and/or structure to the elements of the exemplary embodiment of FIG. 1. For the sake of brevity, only the differences from the exemplary embodiment of FIG. 1 will be looked at.

The electrical contact element 1 is shown with the core body 3 and the cover layer 2. Between the core body 3 and the cover layer 2, a metallic protection layer 13 is provided. The metallic protection layer 13 may be adapted to mechanically enforce the contact element 1 for prolonged durability of the contact element 1. For instance, the metallic protection layer 13 may comprise nickel or a nickel alloy.

The contact element 1 and/or the counter-contact 15 element may be shaped according to the exemplary embodiments of FIGS. 1 and 2. Hence, the contact element 1 and/or the counter-contact element 15 may be shaped with the metallic protection layer 13 between the cover layer 2 and the core body 3.

Figure 3:
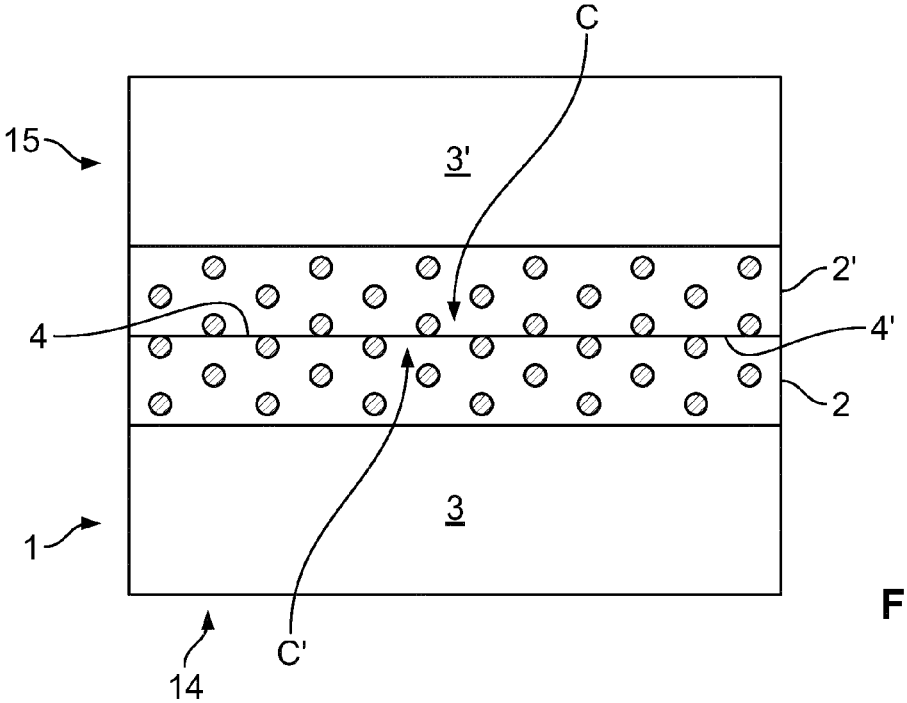
FIG. 3 shows two contact elements according to the exemplary embodiment of FIG. 1 in a schematic cross-sectional view.

FIG. 3 shows a first exemplary embodiment of an electrical contact arrangement 14 with a contact element 1 and a counter-element 13 in a schematic cross-sectional view. The same reference signs are used for elements which correspond in function and/or structure to the elements of the exemplary embodiments of FIG. 1 or 2. For the sake of brevity, only the differences from the exemplary embodiments of FIGS. 1 and 2 will be looked at.

The contact arrangement 14 may comprise at least one electrical contact element 1 which may be adapted to contact the counter-contact element 15 at least with its contact section C. In particular, the counter-contact element 15 may be adapted to mechanically contact the contact surface 4 of the contact element 1.

The counter-contact element 15 may be a standard counter-contact element without the cover layer 2. In the embodiment of FIG. 3, however, also the counter-contact element 15 is shaped with a cover layer 2' and a core body 3'.

The cover layer 2' of the counter-contact element 15 may be arranged in a contact section C' of the counter-contact element 15 and may be provided with a contact surface 4'. In particular, the electrical contact element 1 and the counter-contact element 15 may essentially have a similarly build-up design with respect to the core body 3, 3' and the layers 2, 2', 12. In another possible configuration, the contact element 1 may be shaped with and the counter-contact element 15 without the metallic protection layer 13. Hence, the electrical contact arrangement 14 may comprise at least one contact element 1 and/or at least one counter-contact element 15 that each may be provided with the cover layer 2, 2'.

The two contact elements 1, 15 are shown with interconnected contact surfaces 4, 4', the contact surfaces 4, 4' at least in the area of the contact sections C, C' abutting against each other.

Figure 4:
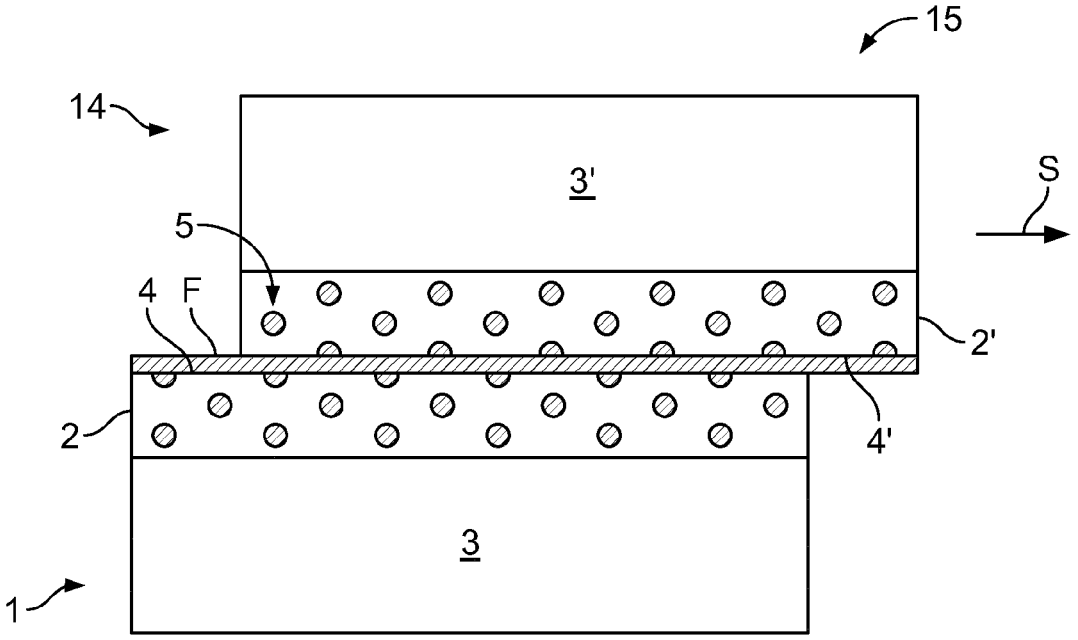
FIG. 4 shows the contact elements of the exemplary embodiment of FIG. 3, one of the contact elements being moved relative to the other contact element.

FIG. 4 shows the exemplary embodiment of FIG. 3, the counter-contact element 15 of FIG. 4 being moved with respect to the electrical contact element 1.

The counter-contact element 15 may have been moved along a direction S parallel to the contact surface 4 due to a plug, an unplug or a switch action by which at least one of the contact elements 1, 15 is moved with respect to the other contact element 13, 1. The contact surface 4' slides on the contact surface 4 during this movement, which may result in abrasion of at least one of the contact surfaces 4, 4' i.e. one of the cover layers 2, 2'. This abrasion may furthermore lead to a release of the chemical reducing agent 5 and/or the lubricant 12. For instance, together with at least one of the contact surfaces 4, 4', one or more particles 8 may rupture and release the chemical reducing agent 5 and/or the lubricant 12 on the respective contact surfaces 4, 4'. The released reducing agent 5 and/or the released lubricant 12 may form a separation or protection film F which, at least section-wise, covers at least one or even both of the contact surfaces 4, 4', in particular, in mechanically charged regions of the contact surfaces 4, 4'. The mechanical charge of the contact surface 4, 4' may thus lead to an exposure of unoxidized cover layer material. The chemical reducing agent 5 and/or the lubricant 12, however, may prevent an oxidization of this material at least in part, e.g. by chemically binding oxygen and/or by separating at least the damaged section of at least one of the contact sections 4, 4' from environmental gases comprising oxygen.

The movement of the counter-contact element 15 with respect to the contact element 1 may furthermore be directed in directions other than the direction S and may also be caused by mechanical vibrations or by thermal elongation still causing damage to the contact surfaces 4, 4'.

Figure 5:
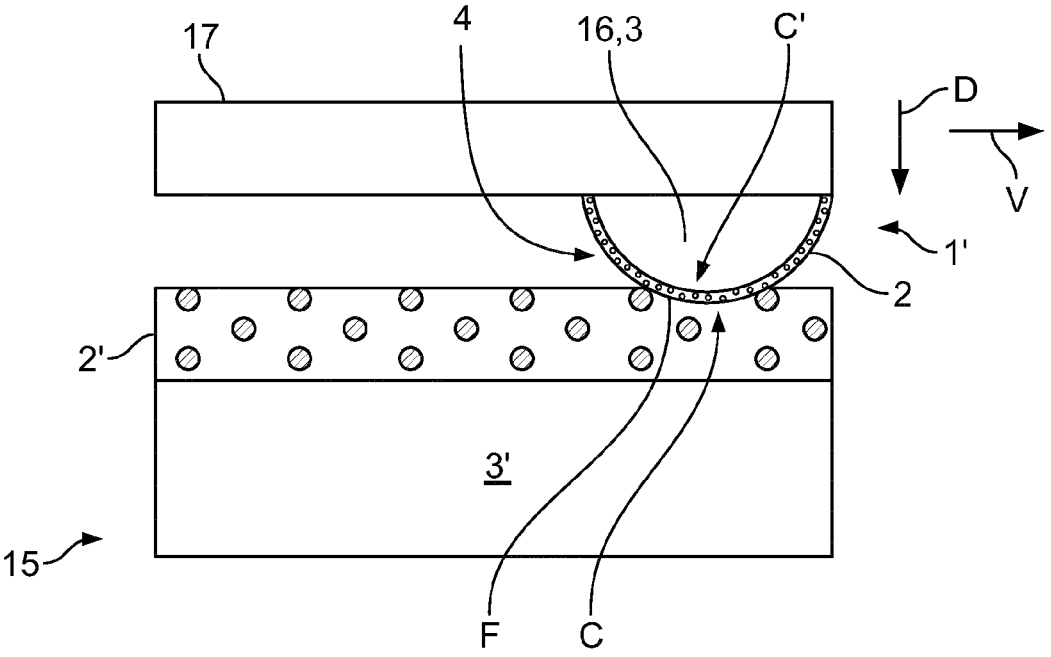
FIG. 5 shows another exemplary embodiment of the contact element, the contact element being a switching contact element.

FIG. 5 shows another exemplary embodiment of the electrical contact arrangement 14 in a schematic cross-sectional view. The same reference signs are used for elements which correspond in function and/or structure to the elements of the exemplary embodiments of FIGS. 1 to 4. For the sake of brevity, only the differences from the exemplary embodiment of FIGS. 1 to 4 will be looked at.

The electrical contact element 1 of FIG. 5 is formed as a switching electrical contact element 1'. For instance, the electrical contact element 1' may comprise a contact pellet 16, which may, at least section-wise, be formed by the core body 3. The contact pellet 16 may be arranged on a contact arm 17 such that it faces the counter-contact element 15. The cover layer 2 may be provided on the contact pellet 16 and/or on the counter-contact element 15 at least on the respective contact sections C, C'.

The counter-contact element 15 may be shaped as the counter-contact element 15 of FIGS. 3 and 4 and as shown in FIG. 5. Alternatively, the counter-contact element 15 may be shaped similar to the switching electrical contact element 1' of FIG. 5 and may be shaped with a counter-contact section, which may be arranged on a contact pellet.

At least one or even both of the contact elements 1', 15 may be provided with the cover layer 2, 2' and even with the metallic protection layer 13 between the contact layer 2, 2' and the core body 3, 3'.

In the embodiment of FIG. 5, both contact elements 1' and 15 are mechanically interconnected via their contact sections C, C'. In the area of the contact sections C, C', at least one of the cover layers 2, 2' may be damaged due to movements of the contact elements 1', 15 relative to each other. The movements may be caused by switching movements along a direction D or by micro-movements in or against a direction V or perpendicular to the direction V and the direction D. The micro-movements may also be caused by thermal elongation or vibration of at least one of the contact elements 1', 15. The reducing agent 5 and/or the lubricant 12 may be released, forming the separation or protection film F in at least a part of the damaged contact surfaces 4, 4'.

The schematic drawings of the above exemplary embodiments shown in FIGS. 1 to 5 and in particular the proportions of the thickness of the layers 2, 2', 13 do not represent any constriction of possible layer thicknesses. The thickness of each layer 2, 2', 13 has to be selected for optimal performance, durability and producibility.

Thick layers may particularly be selected for prolonged durability. However, a thick layer, e.g. a layer with a thickness of more than 1 mm may be hard to apply to the core body 3, 3' or the metallic protection layer 13, e.g. due to coating limitations.

The cover layer 2, 2' may be added to the core body 3, 3' for instance by electroplating, wherein the chemical reducing agent is suspended in a plating bath and is co-deposited with an electrically conductive material. The electrically conductive material may be tin or nickel and may, together with the reducing agent 5 and/or the lubricant 12 form the cover layer 2, 2'.

The invention claimed is:

1. An electrical contact element with a cover layer, arranged at least on a contact section of the contact element, the cover layer being electrically conductive, wherein the cover layer comprises a surface lubricant and also comprises a chemical reducing agent that is adapted to reduce metal oxides of the cover layer and the reducing agent comprises at least one flux material selected from the group consisting of multi-protic fluxing acid, linear fluxing acid, dendritic fluxing acid, branched fluxing acid, abietic acid, stearic acid, and adipic acid, and the reducing agent is provided in particles, and each particle has a receiving body comprised of a material configured to absorb the at least one flux material of the reducing agent through a capillary effect.

2. The electrical contact element according to claim 1, wherein the cover layer is adapted to release at least a part of the reducing agent at least when a contact surface of the cover layer is damaged.

3. The electrical contact element according to claim 1, wherein the reducing agent is embedded in the cover layer.

4. The electrical contact element according to claim 1, wherein the particles comprise at least one solid chemical compound, the compound comprising the reducing agent.

5. The electrical contact element according to claim 1, wherein the receiving body is formed as an outer shell which encloses the reducing agent.

6. The electrical contact element according to claim 1, wherein the particles are formed as microcapsules.

7. The electrical contact element according to claim 1, wherein the particles are adapted to provide chemical reducing action at least when frictional forces between the cover layer and a counter-contact element occur.

8. The electrical contact element according to claim 1, wherein the particles are adapted to have a mechanical resilience that is below the mechanical resilience of the cover layer.

9. The electrical contact element according to claim 1, wherein particles comprise the lubricant.

10. The electrical contact element according to claim 1, wherein the lubricant is a material from a list comprising lubricating polymers, lubricating fluxes, lubricating acids and graphite particles.

11. The electrical contact element according to claim 1, wherein a metallic protection layer is arranged between the cover layer and a core body of the electrical contact element.

12. An electrical contact arrangement with at least one of the electrical contact element and at least one counter-contact element for the electrical contact element, the counter-contact element being adapted to mechanically contact a contact section of the electrical contact element, wherein the electrical contact element is formed according to claim 1.

13. The electrical contact element of claim 1, wherein the surface lubricant is contained in a first plurality of particles embedded in the cover layer and the flux material is contained in a second plurality of particles embedded in the cover layer.

14. The electrical contact element of claim 1, wherein at least one of the particles defines a colloid and the reducing agent is defined as a droplet absorbed within the receiving body.

15. A method for manufacturing an electrical contact element by adding a cover layer wherein the method comprises co-depositing a surface lubricant and an electrically conductive material in a plating bath to form the cover layer; embedding a chemical reducing agent in the cover layer by providing the chemical reducing agent in particles, and each particle includes a receiving body; selecting a flux material of the chemical reducing agent from the group consisting of multi-protic fluxing acid, linear fluxing acid, dendritic fluxing acid, branched fluxing acid, abietic acid, stearic acid, and adipic acid; and absorbing the flux material of the chemical reducing agent into the receiving body through a capillary effect.

16. The method of claim 15, wherein embedding the surface lubricant in the cover layer includes providing a first plurality of particles embedded in the cover layer and containing the surface lubricant and embedding the chemical reducing agent includes providing a second plurality of particles embedded in the cover layer and containing the flux material.

17. A method for reducing oxidization of a contact section of an electrical contact element wherein the method comprises:

applying frictional forces to a cover layer on the contact section;

embedding a surface lubricant in the cover layer;

providing, in the cover layer, a chemical reducing agent having a flux material selected from the group consisting of multi-protic fluxing acid, linear fluxing acid, dendritic fluxing acid, branched fluxing acid, abietic acid, stearic acid, and adipic acid;

receiving the chemical reducing agent within a plurality of particles, each particle having a receiving body comprised of a material configured to absorb the chemical reducing agent through a capillary effect; and releasing the chemical reducing agent in response to the frictional forces.

18. The method of claim 17, wherein embedding the surface lubricant in the cover layer includes providing a first plurality of particles embedded in the cover layer and containing the surface lubricant and providing, in the cover layer, the chemical reducing agent includes providing a second plurality of particles embedded in the cover layer and containing the flux material.

* * * * *